United States Patent [19]

Hoffman, Jr.

[11] 4,309,475

[45] Jan. 5, 1982

[54] BICOMPONENT ACRYLIC FIBER

[75] Inventor: Henry A. Hoffman, Jr., Lugoff, S.C.

[73] Assignee: E. I. Du Pont de Nemours and Company, Wilmington, Del.

[21] Appl. No.: 121,462

[22] Filed: Feb. 14, 1980

[51] Int. Cl.[3] ..... D02G 3/00

[52] U.S. Cl. ..... 428/370; 428/362; 428/374

[58] Field of Search ..... 428/369, 370, 371, 373, 428/374, 359; 526/240, 287, 288; 264/171

[56] References Cited

U.S. PATENT DOCUMENTS

| | | | |
|---|---|---|---|
| 2,983,712 | 5/1961 | Wilkinson . | |
| 3,038,237 | 6/1962 | Taylor, Jr. | 428/370 |
| 3,038,239 | 6/1962 | Moulds | 428/374 |
| 3,039,524 | 6/1962 | Belck et al. | 428/374 |
| 3,092,892 | 6/1963 | Ryan, Jr. et al. | 428/371 |
| 3,547,899 | 12/1970 | Ailt . | |
| 3,923,755 | 12/1975 | Piloni | 526/287 |

FOREIGN PATENT DOCUMENTS

| | | | |
|---|---|---|---|
| 228825 | 5/1958 | Australia | 428/370 |
| 248114 | 8/1960 | Australia | 428/370 |
| 49-94921 | 9/1974 | Japan . | |
| 1265439 | 3/1972 | United Kingdom | 428/374 |
| 2007240 | 5/1979 | United Kingdom . | |

*Primary Examiner*—Lorraine T. Kendell

[57] ABSTRACT

Self-crimping bicomponent acrylic fibers comprising a nonhydrophilic component and a hydrophilic component in eccentric side-by-side relationship which in combination provide an equilibrium crimp reversibility (ECR) of at least about 20% have as the hydrophilic component a copolymer of acrylonitrile containing 0.7 to 1.2 mol percent 2-acrylamido-2-methylpropanesulfonic acid or salts thereof having a total ionizable group content of 180 to 270 milliequivalents per kilogram of copolymer.

2 Claims, 2 Drawing Figures

BICOMPONENT ACRYLIC FIBER

This invention relates to improved bicomponent acrylic fibers derived from acrylonitrile copolymers containing 2-acrylamido-2-methylpropanesulfonic acid or salts thereof (AMPS).

Self-crimpable bicomponent acrylic fibers consisting of two or more components in side-by-side eccentric relationship are well-known, e.g., from U.S. Pat. Nos. 3,038,237 and 3,039,524. In cases where one of the components is sufficiently hydrophilic to swell appreciably on exposure to water while the other component is not, the bicomponent fibers exhibit "squirm" in that the crimp is decreased when the hydrophilic component becomes swollen with water and is regained when the swelling decreases on drying. Such a fiber may be comprised of an acrylonitrile homopolymer in admixture with 15% by weight of a copolymer of acrylonitrile and 4.4% by weight sodium styrene sulfonate as one component and the same copolymer as the other component, the two components being in eccentric side-by-side relationship. While this fiber has a suitable level of crimp for commercial use and displays a satisfactory level of "squirm" on repeated wetting and drying cycles, the level of sulfonic acid comonomer required to get the water swellability needed for the desired crimping behavior requires considerable additional expense since the usual comonomer for providing water swellability, sodium styrene sulfonate, is relatively expensive. It would therefore be desirable to provide a hydrophilic component for the preparation of bicomponent acrylic fibers which provides the desired crimping behavior while using less of the sulfonic acid containing comonomer.

BRIEF SUMMARY OF THE INVENTION

The self-crimping bicomponent acrylic fiber of this invention has higher levels of crimp than would be expected from the sulfonic acid content of the hydrophilic component of the fibers.

This invention provides a self-crimping bicomponent acrylic fiber comprising a nonhydrophilic component and a hydrophilic component in eccentric side-by-side relationship which in combination provide an equilibrium crimp reversability (ECR) of at least about 20% wherein the hydrophilic component is a copolymer of acrylonitrile containing 0.7 to 1.2 mol percent 2-acrylamido-2-methylpropanesulfonic acid or salts thereof having a total ionizable group content of 180 to 270 milliequivalents per kilogram of copolymer. Preferably, the hydrophilic component contains 0.85 to 0.95 mol percent 2-acrylamido-2-methylpropanesulfonic acid or salts thereof having a total ionizable group content of 204 to 222 milliequivalents per kilogram of copolymer.

The bicomponent acrylic fibers can be prepared by spinning processes known in the art, e.g., from U.S. Pat. Nos. 3,038,237 and 3,039,524 using acrylonitrile polymers prepared in the usual ways, e.g., by redox polymerization.

Surprisingly, the bicomponent acrylic fibers of this invention provide greater dyeability with basic dyes than would be expected from the total acid group content of the fibers yet provide lower dyeability with disperse dyes than would be expected.

DETAILED DESCRIPTION OF THE INVENTION

Figure 1:
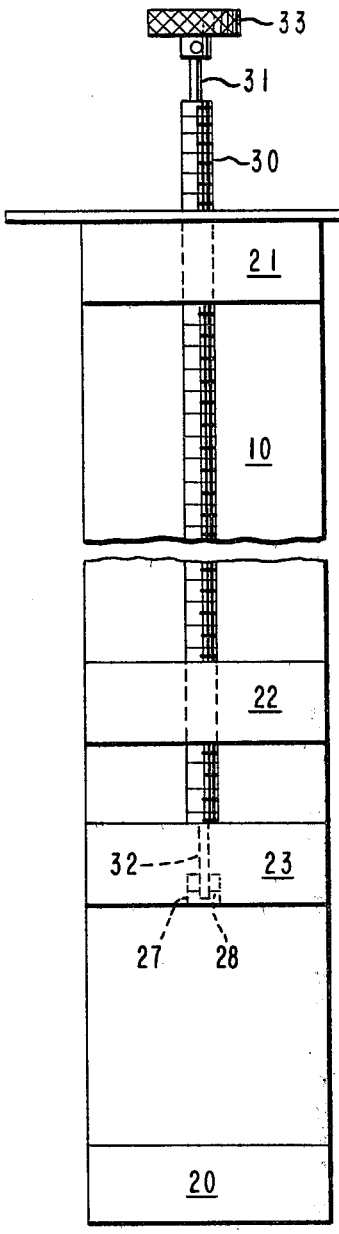
FIG. 1 is a front elevational view of a holder used to measure ECR.

The acrylic fibers of this invention have an eccentric bicomponent structure in which a large difference exists between the hot water swellabilities of the two components as described in U.S. Pat. No. 3,092,892 issued to Ryan et al. on June 11, 1963 and indicated by the ECR of the filament. By "hot" water is meant that the water has a temperature in the region of from about 70° C. up to about the boiling point of water. A higher ECR reflects a higher differential between the dry and wet length of the filament components. While the filaments can have an ECR higher than about 60%, such filaments are not easily prepared on a commercial basis. However, a minimum ECR of about 20% is necessary to obtain the minimum differential in the swellability of the filament components which will provide adequate crimp development. Filaments having an ECR of about 20–60% exhibit pronounced differential crimp changes ("squirm") on drying. This arises because the filaments comprise two components in a substantially eccentric relationship in the sense that the cross sections of the components, which have different hot-water swellabilities, have center points that do not coincide. Such filaments generally develop a pronounced helical crimp on relaxed exposure to conditions that permit relief of stresses imparted during their manufacture. Within a most preferred range of ECR of about 30–50%, optimum helical crimp is developed on drying. When the more hot water swellable component is situated on the inside of the crimp helices, the filament loses some of its crimp under hot-wet conditions and regains it on drying. The reverse occurs when the more hot water swellable component is on the outside of the crimp helices. Hence, when the more hot water swellable component is on the inside in the dry state, adequate crimp development occurs on drying and the filaments have a positive ECR.

The prior art teaches that both copolymers and polymer mixtures can be used to adjust the level of the hot water swellability of the components of a bicomponent filament. For example, hot water swellability is enhanced by incorporating in the filament component polymers units of ionizable monomers which confer or enhance dye receptivity to the polymers as illustrated in U.S. Pat. Nos. 3,038,237; 3,039,524 and the like. Nonionic monomers that confer or enhance hot water swellability to the filament components are illustrated in U.S. Pat. Nos. 3,400,531; 3,470,060; 3,624,195 and 3,719,738. Blends of an acrylic polymer and a highly hot water swellable polymer can also be used as discussed in U.S. Pat. No. 3,038,239. The composite filaments described in U.S. Pat. No. 3,092,892 are eminently suitable for use in the practice of this invention.

The polymer functioning as the component having higher hot-water swellability is a copolymer of acrylonitrile and 0.7–1.2 mol percent 2-acrylamido-2-methylpropanesulfonic acid or a salt thereof having a total ionizable group content of 180–270 milliequivalents per kilogram of polymer.

Polymers or blends of polymers which can function as the filament component having lower hot water swellability include those comprising (A) about 80–100% by weight of a polymer comprising about 85–100% by weight of units derived from acrylonitrile and 0 to about 15% by weight of units derived from a monomer copolymerizable with acrylonitrile and which is less hydrophilic than a monomer of (2) below including methyl acrylate, methyl methacrylate, vinyl acetate, methacrylonitrile and the like and mixtures thereof, and (B) about 20–0% by weight of a polymer comprising (1) about 85–98% by weight of units derived from acrylonitrile; (2) about 2–10% by weight of units derived from one or more of styrenesulfonic acid (o-, m- or p-isomer), 2-acrylamido-2-methylpropanesulfonic acid, allylsulfonic acid, methallylsulfonic acid, vinyl-sulfonic acid, or their metal-, ammonium or amine salts, a vinyl pyridine such as 2-vinyl pyridine or 2-methyl-5-vinyl pyridine, vinyl pyrrolidone, acrylamide, methacrylamide, hydroxymethyl acrylamide and the like and mixtures thereof and (3)0 to about 13% by weight of units derived from any other copolymerizable monomer known in the art which is less hydrophilic than units of a monomer of (2), including methyl acrylate, methyl methacrylate, vinyl acetate, methacrylonitrile and the like and mixtures thereof. It is preferred to employ either polyacrylonitrile or a blend of polyacrylonitrile and up to 20% by weight of the copolymer of the more hot-water swellable component.

Tests

Crimp and Tow Shrinkage

The measurement of total tow shrinkage (TTS) tow crimp shrinkage (TCS) and total fiber shrinkage (TFS) uses a full-sized tow, of about 470,000 denier. The length of the tow sample is measured on an Instron under three conditions as described below. These lengths are:

$L_o$=as-is, uncrimped tow length $L_1$=crimped dried tow length after steam relaxation $L_2$=uncrimped dried tow length after steam relaxation The properties are calculated as:

$$TTS = \frac{L_o - L_1}{L_o} \times 100$$

$$TCS = \frac{L_2 - L_1}{L_o} \times 100$$

$$TFS = \frac{L_o - L_2}{L_o} \times 100$$

The measurements are made as follows:

$L_o$: A length of tow, which has been conditioned at 21° C., 65% RH, conveniently one that will yield a value of $L_o$ around 30" (76 cm), is clamped in an Instron Tensile Tester. The length between clamps is increased at 50% per minute to effect a loading of about 160 lbs. (73 kg), about 0.15 g/den or 0.017 g/tex. The straight-line portion of the stress-strain curve developed is extrapolated to the zero-load baseline and the intersection read as the length to be added to the original clamps separation to give $L_o$.

$L_1$ and $L_2$: The length of tow is removed from the Instron and placed in a mesh bag. The sample is soaked in water for 1 minute, placed in an autoclave and steamed at 220° F. (104° C.) for 10 minutes. The autoclave is vented; the sample is removed and tumble dried at 180° F. (82° C.) for 30 minutes.

After conditioning at 21° C., 65% RH for at least 15 minutes, the tow is placed in the Instron again and the same stress-strain curve developed. Extrapolation of the straight-line curve portion which includes loading at 160 lbs. (73 kg) to the intersection with the zero-load baseline gives a length which, when added to the original clamps separation, yields $L_2$. $L_1$ is the sum of the original clamps separation distance and the length read from the stress-strain curve at 5 lbs. (2.3 kg) loading. At this small (0.008 g/den or 0.00089 tex) loading, the tow is straightened out without removing appreciable crimp.

Dye on Fiber

Basic Dyes

Staple fibers are dyed in cheesecloth bags at the boil in excess Sevron® Red GL (Colour Index Basic Red 18) for 45 minutes. Well rinsed samples are dried, weighed and dissolved in N,N-dimethyl-formamide. The percent dye on fiber is obtained by measurement of optical density as compared to standard solutions.

Disperse Dyes

Staple fibers are dyed in cheesecloth bags at the boil in 4 g/liter Celanthrene Blue FFS (Colour Index Disperse Blue 3) for 30 minutes at a dilution of 6 g fiber/liter. The fibers are scoured, rinsed, dried and analyzed optically as above.

Equilibrium Crimp Reversibility (ECR)

Tows of dried, crimped filaments to be tested are cut to chips of about 10 cm crimped length and the chips are given a relaxed, 30-minute boil-off loosely wrapped in a single thickness of cheesecloth. They are dried for 30 minutes in an oven at 70° C.

Fibers are selected randomly from the boiled off and dried chips and mounted in holders designed to measure ECR as illustrated in the Figures in which like numerals refer to the same element. In the figures, holder base 10 is a sheet of black plastic about 3.8 cm wide, 0.6 cm thick and 20 cm long. Three blocks of aluminum 20, 21 and 22 about 1.3 cm square and 3.8 cm long are firmly attached to one face of the base. The first block 20 is attached across the bottom end of base 10. Another block 21, attached across the top end of base 10 is drilled through its center and parallel to the length of base 10 to just allow an 18 cm long, fully threaded rod 30, approximately 0.6 cm in diameter to pass through. The third block 22 is drilled similarly to block 21, except that it is threaded and positioned about 8 cm above bottom block 20. The diameter of rod 30 is reduced on a lathe at each end 31, 32 to about 0.3 cm for a length of about 0.8 cm. A knurled knob 33 is securely attached to end 31. A fourth aluminum block 23 of the same dimensions as the three mounted blocks is movable and is drilled from the center of one face to pass freely end 32 of threaded rod 30. From one face the hole is counterdrilled to give a counterbore 27 of about 0.6 cm diameter and about 0.7 cm depth, leaving a flat bottom. A disc of aluminum 40 about 0.16 cm thick and about 6.3 cm in diameter is drilled through its center to pass the threaded rod and is firmly attached to the top of aluminum block 21 to serve as a hanger for the holder.

The apparatus is assembled by passing the free end of threaded rod 30 through aluminum disc 40 and top block 21, screwing it through threaded block 22, and passing end 32 through the loose block 23 so that it terminates in counterbore 27 where it is secured with compression washer 28, leaving enough clearance to permit free turning of rod 30. By turning knob 33, movable block 23 is positioned approximately 5 cm from bottom block 20.

One end of each of five boiled-off and dried fibers is taped to movable block 23. The other ends are then taped to bottom block 20 after pulling out slack but not crimp, using care to leave about the same crimped length of fibers between the blocks. Holder base 10 is labeled to identify the sample, and movable block 23 is moved down to provide definite slack in the fibers.

When the required number of fibers have been loaded into holders, the required number of the holders are placed for at least 30 minutes in a glass-walled bath of water maintained at 70° C. Movable block 23 of each holder is moved upward to remove slack from the fibers, and the wet crimp therein counted using a cathetometer; each convexity on one side of the fiber is regarded as a crimp.

The holders are removed from the bath; fiber slack is re-established by moving block 23 downward; the holders are placed in a 70° C. oven for about thirty minutes and then stored at room temperature (about 21° C., 65% relative humidity) for 30 minutes. Dry crimps are counted as described above after removing slack.

$$ECR = \frac{(\text{No. of crimps dry} - \text{No. of crimps wet})}{\text{No. of crimps dry}} \times 100$$

Determinations on about 100 fibers are required for good reliability.

Bulk Dye Index

The bulk dye index (BDI) of a sample fiber is expressed relative to that of other fiber samples which previously have been calibrated relative to an arbitrary standard. Ordinarily as many as five calibrated samples are used, which decreases the probability of error due to small variations in dyeing procedure or bath composition. The calibrated samples are selected to have about the same dye receptivity, denier-per-filament and lustre as the test item.

Approximately 3 g samples of the test fiber and the calibrated samples are individually carded to yield 3"×6" (7.5×15-cm) pads.

A bath is prepared comprising 400 cc of water containing the following tabulated ingredients for each gram of fiber to be dyed:

| | |
|---|---|
| Cationic-dye-stripper commonly used for stripping azoic dyes | 0.025 g |
| Acetic acid (99–100%) | 0.005 g |
| Sodium acetate | 0.005 g |
| Sodium sulfate (as anhydrous) | 0.10 g |
| Nonionic surfactant commonly used as dyeing assistant | 0.01 g |
| CI Basic Red 18 | 0.05 g |

The bath is heated to 70° C., and the samples, including those previously calibrated against the standard, are placed in individual baskets affixed to a frame designed to rotate while immersed in the bath. It is submerged in the above-described bath and slowly rotated while the bath is rapidly brought to the boil and held at that temperature for 20 minutes. The bath is then drained away and replaced by fresh water, which is also drained after brief rinsing of the samples. This rinse is repeated once, then the vessel is filled with water containing 1%, based on the weight of fibers being dyed, of the surfactant used in the dyeing step. The bath is boiled for 30 minutes, drained away and the samples thoroughly washed with water and centrifuged to remove any water adhering to the surface of the fibers.

Each dyed pad is carded again to 3"×6" (7.5×15-cm) pads and evaluated for dye pick-up in a Hunter D-25 colorimeter using a wavelength band approximating the color of the dye used in the dye bath. The reflectance value of each sample is recorded.

The value of reflectance for each test sample, adjusted as indicated by the values obtained on the calibrated samples which have been dyed competitively in the bath with it, is used to calculate K/S value by the method of Kubelka and Munk, *Z. Tech Physik,* 12, 593–601 (1931), using the equation.

$$K/S = \frac{(1 - \text{reflectance})^2}{(2 \times \text{reflectance})}$$

(K/S being the ratio of absorption to scattering) BDI is calculated by the equation:

$$BDI = \frac{K/S \text{ sample}}{K/S \text{ calibrated sample}} \times BDI \text{ of calibrated sample.}$$

EXAMPLE 1

Into a well-agitated, jacketed vessel equipped with an overflow at the 1800 parts by weight level are continuously fed the following ingredients while maintaining the temperature of the resulting polymer slurry at 60° C. by controlled circulation of cold water through the jacket.

| | Parts by Weight/Min. |
|---|---|
| Acrylonitrile | 14.0 |
| Sodium-2-Acryl-Amido-2-Methyl Propane Sulfonate (AMPS) | 1.07 (as a 7% solution in water) |
| Sodium Bisulfite | 0.4 (as a 2.6% solution in water containing sufficient ferrous sulfate to provide 1.0 parts per million iron in the total reactor feed) |
| Potassium Persulfate | 0.04 (as a .25% solution in water) |
| Sulfuric Acid to pH 2.6 | (about 0.98% on monomers) |

Residence time in the reactor at these flow rates is 30 min. Monomers concentration in the feeds is 25%.

The overflowing polymer slurry, which is representative of the total reactor contents, is treated with an excess of an iron-complexing agent, ethylenediaminetetraacetic acid as the tetra-sodium salt, to stop the polymerization reaction; the polymer is filtered off, thoroughly washed with hot water and dried to <1% moisture. Samples taken at various times having 230-246 milliequivalents/kg. acid group were blended to provide a blend having 245 meq./kg. acid groups. This polymer is identified as Polymer A.

Polymer A, two additional copolymers B and C prepared in the same way, except for extent of modification by AMPS, and a fourth copolymer D in which sodium styrenesulfonate (SSS) replaces AMPS, are used to prepare bicomponent fibers. Polymer B has 182 meq./kg. acid groups obtained by blending polymers having 179-191 meq./kg. acid groups. Polymer C has 214 meq./kg. acid groups obtained by blending polymers having 207–221 meq./kg. acid groups. Polymer D has 245 meq./kg. acid groups obtained by a long term continuous polymerization at equilibrium. The fibers are spun substantially as taught in the first paragraph of example III of U.S. Pat. No. 3,092,892. This is a dry-spinning process in which about equal parts of two polymer solutions in dimethylformamide (DMF) are merged in each spinneret orifice to result in side-by-side bicomponent filaments, one component of each consisting essentially of one of the Polymers A through D and the other component consisting essentially of about 85% of polyacrylonitrile having an intrinsic viscosity of 2.0 and about 15% of the copolymer with which it is cospun.

After passage through a heated chimney cocurrently with a stream of hot, inert gas, the filaments are found to contain about 30% solvent. Each lot is combined into a tow and extracted in a series of water baths at 95°–100° C. while being drawn to 425% of its as-spun length. After mechanical crimping and cutting to a length to provide 3½–4 inch (8.9–10.2 cm) staple fibers when dried to <2% moisture, the staple fibers are processed on the worsted system) to 4×91 tex. yarns.

The following table summarizes fiber and spun-yarn properties:

| | A | B | C | D |
|---|---|---|---|---|
| Mol % AMPS | 1.10 | 0.73 | 0.92 | 1.10 SSS |
| Intrinsic viscosity | 1.5 | 1.5 | 1.5 | 1.5 |
| Milliequivalents acid group per kg. polymer | 245 | 182 | 214 | 245 |
| Acid end groups | 48 | 48 | 48 | 48 |
| Tow crimp shrinkage, % | 29.1 | 15.4 | 25.2 | 25.2 |
| Total Tow shrinkage, % | 36.2 | 19.0 | 31.5 | 31.0 |
| Disperse dyeability | 6.38 | 3.82 | 4.89 | 9.35 |
| Relative disperse dyeability | 68 | 41 | 52 | 100 |
| Basic dyeability dye on fiber | 16.9 | 9.2 | 11.8 | 9.8 |
| Relative basic dyeability | 172 | 94 | 120 | 100 |

These results show that AMPS provides equivalent crimp properties with lower polymer modification.

EXAMPLE 2

This example illustrates preparation of (A) a copolymer of acrylonitrile and 2-acrylamido-2-methylpropanesulfonate which is useful in practice of this invention and, for comparison, (B) the preparation of a copolymer of acrylonitrile and sodium styrenesulfonate as taught by Andres et al. U.S. Pat. No. 2,837,500.

(A) Into a well-agitated, jacketed continuous polymerization vessel having a capacity of 95 parts by weight to an overflow is fed 29 parts per hour of monomers consisting of acrylonitrile and sodium 2-acrylamido-2-methylpropanesulfonate (AMPS) in a weight ratio of 10.78:1 (2.1 mol % AMPS) and 71 parts per hour of water, a portion of which is used to dissolve the following: 0.067 parts potassium persulfate, 0.29 parts sodium metabisulfite, 0.42 parts sulfur dioxide and sufficient ferrous sulfate to result in 1.3 ppm iron on the total reactor contents. The pH is found to be 2.30. The temperature is maintained at 55° C. by circulation of cooling water in the jacket.

The polymer precipitates as a suspension in the aqueous medium, which overflows continuously to a holding vessel where it is treated with 100 times the stoichiometric amount of iron-complexing agent, adjusted with sodium carbonate to a pH of 5.0 which leaves the polymer with 0–1 milliequivalents of acidity/kg.

From the holding vessel, the slurry is pumped continuously to a vacuum filter where the polymer is removed and washed with warm water. After drying to less than 1% water, the polymer is blended and found to have an intrinsic viscosity of 1.5 and a combined acidity of 240 meq./kg. acid groups, corresponding to an AMPS content of 4.41% by weight (1.05 mol %).

(B) As a comparison, the preceding reaction is repeated except that sodium styrenesulfonate (SSS) replaces the AMPS; the ratio of monomers fed is 28.4:1 by weight (0.9 mol % SSS). Monomers fed amount to 25 parts, potassium persulfate 0.06 parts, sodium metabisulfite 0.65 parts, iron 1.0 ppm, sulfur dioxide 0.0875 parts (all on a per-hour basis), and the resulting pH is 3.05.

The dried and blended polymer has an intrinsic viscosity of 1.5 and an acidity of 247 meq./kg. acid groups corresponding to an SSS content of 4.10% (1.09 mol %).

Figure 2:
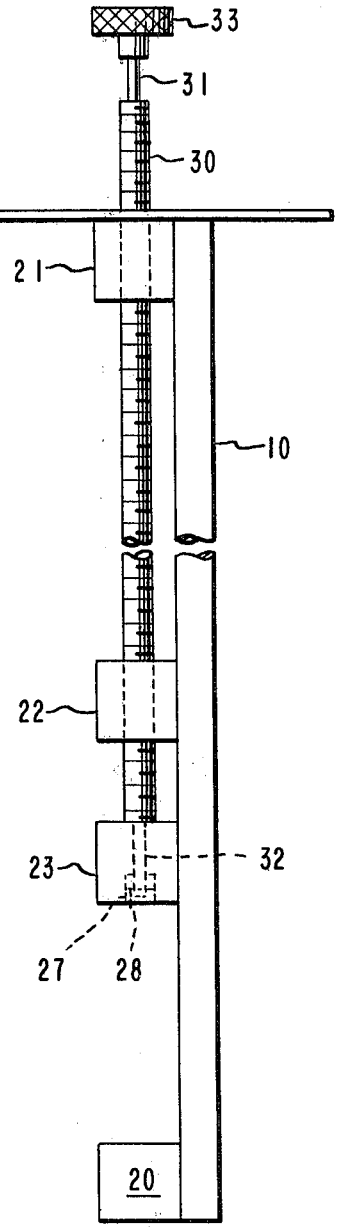
FIG. 2 is a side elevational view of a holder used to measure ECR.

Dimethylformamide solutions are prepared containing (1) 24% by weight of a mixture of 87 parts of polyacrylonitrile having an intrinsic viscosity of 2.0 and 13 parts Polymer A; and (2) 31% by weight of Polymer A, also containing 0.35% $TiO_2$, as a delusterant, based on polymer content, to yield 0.21% $TiO_2$ in the finished fiber. Equal volumes of these solutions are fed to a multi-orifice spinneret of the type generally described in FIGS. 1–3 of Taylor U.S. Pat. No. 3,038,237 and the bicomponent extrudate solidified by evaporation of most of the solvent in a cocurrent stream of hot, inert gas. The as spun filaments contain about 30% solvent; they are extracted in hot water while being drawn to 400% of their as-spun length. They are accumulated into a tow, mechanically crimped and dried to less than 2% moisture at 141° C. This is tow 1.

Total shrinkage is 36.8%, representing 8.5% fiber shrinkage and 28.3% retraction due to crimp. The bulk dye index is 91.1.

The foregoing preparation is repeated in all respects except that Polymer B is substituted for Polymer A. This is tow 2.

Total shrinkage of this item is 33%, representing 7.6% fiber shrinkage and 25.4% retraction due to crimp. Bulk dye index is 99.4.

A further illustration of the greater effectiveness per mol of AMPS as a copolymeric modifier is seen in a comparison of the cohesiveness of slivers made from the two items. In this test, 60-grain slivers of each item prepared on the worsted system are drafted on a Rothschild Cohesion Tester at 5 meters/min. feed and 25% draft. The higher force required (16–17.8 mg/tex) to draft the sliver from tow 1 than that (12.5–13.9 mg/tex) required to draft the sliver from tow 2 is a direct result of the greater crimp development in the fibers of tow 1. The increased cohesion of bicomponent fibers having Polymer A as one component is a manifestation of the increased helical crimp developed during water removal at high temperature in the manufacturing process.

I claim:

1. A self-crimping bicomponent acrylic fiber comprising a nonhydrophilic component and a hydrophilic component in eccentric side-by-side relationship which in combination provide an equilibrium crimp reversibility (ECR) of at least about 20% wherein the hydrophilic component is a copolymer of acrylonitrile containing 0.7 to 1.2 mol percent 2-acrylamido-2-methylpropanesulfonic acid or salts thereof having a total ionizable group content of 180 to 270 milliequivalents per kilogram of copolymer.

2. The bicomponent acrylic fiber of claim 1 wherein the hydrophilic component is an acrylonitrile copolymer containing 0.85 to 0.95 mol percent 2-acrylamido-2-methylpropanesulfonic acid or salts thereof having a total ionizable group content of 204 to 222 milliequivalents per kilogram of copolymer.

* * * * *